US011440095B2

(12) United States Patent
Fribourg et al.

(10) Patent No.: US 11,440,095 B2
(45) Date of Patent: Sep. 13, 2022

(54) METHOD FOR HEAT TREATING A PREFORM MADE OF TITANIUM ALLOY POWDER

(71) Applicants: SAFRAN AIRCRAFT ENGINES, Paris (FR); ALLIANCE, Saint-Vit (FR)

(72) Inventors: Guillaume Fribourg, Grenoble (FR); Jean-Claude Bihr, Saint Vit (FR); Clément Gillot, Plumont (FR)

(73) Assignees: SAFRAN AIRCRAFT ENGINES, Paris (FR); ALLIANCE, Saint Vit (FR)

( * ) Notice: Subject to any disclaimer, the term of this patent is extended or adjusted under 35 U.S.C. 154(b) by 13 days.

(21) Appl. No.: 17/193,628

(22) Filed: Mar. 5, 2021

(65) Prior Publication Data

US 2021/0187609 A1 Jun. 24, 2021

Related U.S. Application Data

(62) Division of application No. 15/741,844, filed as application No. PCT/FR2016/051710 on Jul. 6, 2016, now Pat. No. 10,967,430.

(30) Foreign Application Priority Data

Jul. 6, 2015 (FR) ..... 1556375

(51) Int. Cl.
*B22F 3/10* (2006.01)
*C22C 14/00* (2006.01)
(Continued)

(52) U.S. Cl.
CPC ..... *B22F 3/10* (2013.01); *B22F 3/003* (2013.01); *B22F 7/02* (2013.01); *C22C 14/00* (2013.01);
(Continued)

(58) Field of Classification Search
None
See application file for complete search history.

(56) References Cited

U.S. PATENT DOCUMENTS 4,846,393 A 7/1989 Devillard
5,052,930 A 10/1991 Lodde
(Continued)

FOREIGN PATENT DOCUMENTS

CN 101423922 A 5/2009
CN 102455122 A 5/2012
(Continued)

OTHER PUBLICATIONS

International Search Report as issued in International Patent Application No. PCT/FR2016/051710, dated Sep. 30, 2016.
(Continued)

*Primary Examiner* — Brian D Walck
*Assistant Examiner* — Christopher D. Moody
(74) *Attorney, Agent, or Firm* — Pillsbury Winthrop Shaw Pittman LLP

(57) ABSTRACT

A method for heat treating a powder part preform including a titanium-based alloy, wherein the method includes the heat treatment of the preform in a furnace at a predetermined temperature, wherein the preform is on a holder during the heat treatment, wherein the holder includes a zirconium-based alloy having a zirconium content greater than or equal to 95% by weight, wherein the holder material has a melting temperature higher than the predefined temperature of the heat treatment, and wherein an anti-diffusion barrier is arranged between the preform and the holder in order to prevent welding of the preform to the holder.

7 Claims, 1 Drawing Sheet

(51) Int. Cl.

| | |
|---|---|
| ***C22C 16/00*** | (2006.01) |
| ***F27D 3/12*** | (2006.01) |
| ***F27D 5/00*** | (2006.01) |
| ***B22F 3/00*** | (2021.01) |
| ***B22F 7/02*** | (2006.01) |
| ***B22F 5/04*** | (2006.01) |

(52) U.S. Cl.

CPC ..... *C22C 16/00* (2013.01); *F27D 3/12* (2013.01); *F27D 5/00* (2013.01); *F27D 5/0018* (2013.01); *F27D 5/0062* (2013.01); *B22F 3/1003* (2013.01); *B22F 5/04* (2013.01); *B22F 2003/1046* (2013.01); *B22F 2203/11* (2013.01); *B22F 2301/205* (2013.01); *B22F 2998/10* (2013.01); *B22F 2999/00* (2013.01)

(56) References Cited

U.S. PATENT DOCUMENTS

| | | | |
|---|---|---|---|
| 5,911,102 | A | 6/1999 | Takahashi |
| 6,027,686 | A | 2/2000 | Takahashi |
| 9,321,104 | B2 | 4/2016 | Hachenberg |
| 2002/0092324 | A1 | 7/2002 | Ganguli et al. |
| 2013/0008027 | A1 | 1/2013 | Franchet |
| 2013/0149186 | A1 | 6/2013 | Hachenberg et al. |
| 2015/0176416 | A1 | 6/2015 | Burghardt et al. |
| 2017/0203362 | A1 | 7/2017 | Cha |

FOREIGN PATENT DOCUMENTS

| | | | |
|---|---|---|---|
| CN | 104087772 | A | 10/2014 |
| CN | 104722916 | A | 6/2015 |
| JP | H10-273703 | A | 10/1998 |
| JP | 2002-030305 | A | 1/2002 |
| JP | 2006-104559 | A | 4/2006 |

OTHER PUBLICATIONS

Office Action as issued in Japanese Patent Application No. JP 2018-520029, dated Jul. 14, 2020.

A. Abdelkefi, D. Guines, L. Leotoing, S. Thuillier. Incremental forming of Titanium T40 sheet: experimental and numerical investigations. 24ème Congrès Français de Mècanique, Aug. 2019, Brest, France. ffhal-02328578f (Year: 2019).

Product Data of Ti 6Al 4V, Space Materials DataBase, https://www.spacematdb.com/spacemat/datasearch.php?name=Ti%206Al%204V (Year: 2020).

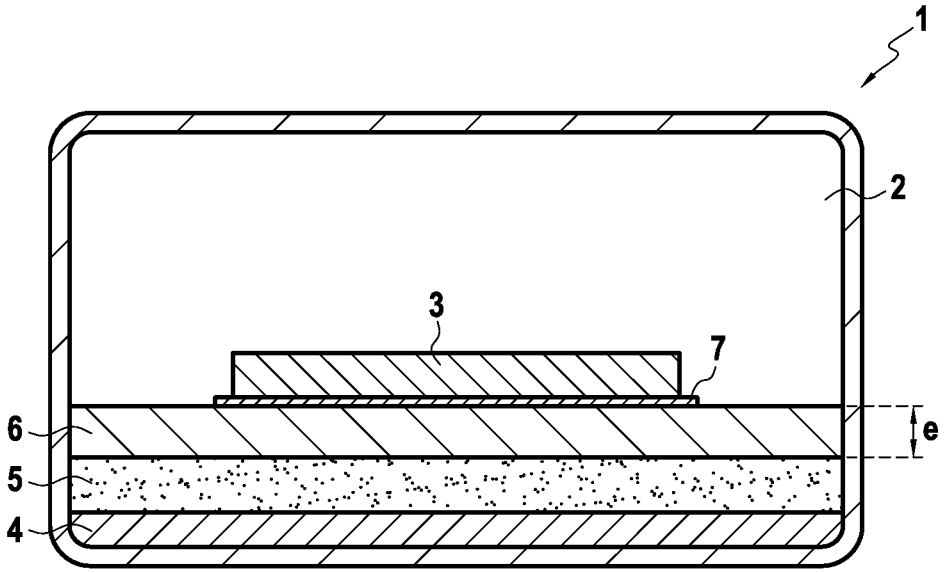
1
2
3
7
6
5
4
e

METHOD FOR HEAT TREATING A PREFORM MADE OF TITANIUM ALLOY POWDER

CROSS REFERENCE TO RELATED APPLICATIONS

This application is a divisional of U.S. application Ser. No. 15/741,844 filed on Jan. 4, 2018, which is the U.S. National Stage of PCT/FR2016/051710 filed Jul. 6, 2016, which in turn claims priority to French Application No. 1556375 filed Jul. 6, 2015. The contents of both applications are incorporated herein by reference in their entirety

BACKGROUND OF THE INVENTION

The present invention relates to the general field of heat treatment of powder preforms. The invention applies more particularly, but not exclusively, to the sintering of preforms of three-dimensional parts obtained by shaping a titanium-based alloy powder.

It is now common to use methods for manufacturing three-dimensional parts made of metal (or metal alloy) or ceramic by implementing a step of shaping a powder in order to obtain a preform (for example using a powder injection molding technique (PIM or MIM) by means of a binder, hot isostatic pressing, or "tape casting"), followed by a step of sintering the preform.

The sintering of the preform consists of a heat treatment at high temperature (typically the sintering temperature is between 70% and 99% of the melting temperature of the material forming the powder of the preform, or even higher than this melting temperature in the case of liquid phase sintering), which is intended to densify the powder in order to obtain a consolidated one-piece part.

For titanium-based alloys (e.g. TiAl6V4, TiAl-48-2-2, etc.), which are particularly sensitive to oxidation, the sintering conditions must be carefully controlled in order to minimize contamination of the finished part by oxygen. In fact, the presence of oxygen in the finished part significantly deteriorates its properties and mechanical strength.

In the sintering conditions generally used for these titanium-based alloys, especially in the case of a sintering temperature higher than 1100° C., the contamination of the finished parts is relatively significant following the sintering. Oxygen sources potentially contaminating the part during sintering have been identified as being among the following:

- traces of oxygen contained in the atmosphere of the furnace enclosure,
- the humidity of the furnace, and
- the oxygen present in the sintering tools (such as the plate supporting the preform or the furnace itself).

It is known to use oxygen getters or oxygen traps, for example in the form of metal chips arranged around the preform, which absorb oxygen by oxidizing.

However, these oxygen traps do not allow a satisfactory level of oxygen contamination to be obtained on the aforementioned alloys, which results in insufficient mechanical strength of the final part.

OBJECT AND SUMMARY OF THE INVENTION

The main object of the present invention is, therefore, to overcome such disadvantages by proposing a method of heat treatment of a powder part preform comprising a titanium-based alloy, wherein the method comprises heat treatment of the preform in a furnace at a predefined temperature, wherein the preform is on a holder during the heat treatment. The method is characterized in that the holder comprises a titanium-based alloy having a titanium content greater than or equal to 45% by weight, or a zirconium-based alloy having a zirconium content greater than or equal to 95% by weight, wherein the holder material has a melting temperature higher than the predefined temperature of the heat treatment, and wherein an anti-diffusion barrier is arranged between the preform and the holder in order to prevent welding of the preform to the holder.

The method according to the invention is, in particular, remarkable in that the holder on which the preform is placed makes it possible to reduce the oxygen contamination of the final part following the heat treatment (this heat treatment may be sintering).

First of all, since the holder comprises a high titanium mass content alloy (typically more than 45%) or a high zirconium mass content alloy (typically more than 95%), it can absorb traces of oxygen in the atmosphere present in the furnace enclosure. In fact, titanium or zirconium can easily absorb surrounding oxygen by oxidizing.

In addition, the holder makes it possible to absorb the oxygen that may have already contaminated the preform. In fact, titanium and zirconium are more reductive than the titanium oxide ($TiO_2$) formed during the oxidation of the titanium present in the preform. Thus, the holder acts as an oxygen trap for the oxygen present in the preform.

In the prior art, during the sintering of titanium-based alloy powder preforms, the preform is typically placed on a ceramic tray (for example made of zirconia, alumina or yttria). It has been noted that ceramic gradually degrades after several sintering cycles. An oxidation-reduction reaction occurs between the ceramic tray and the part, resulting in the reduction of the tray ceramic, and the enrichment of the part in oxygen.

With the method according to the invention, the preform is arranged on the holder and is not in contact with other tools present in the furnace (such as a sole, or a ceramic tray such as those presented above), which advantageously prevents these tools from contaminating the preform. In other words, the holder acts as a barrier or buffer for oxygen between these tools and the preform.

Finally, since the holder consists of a material having a melting temperature higher than the predetermined temperature of the heat treatment (for example the temperature of a sintering step), the plate is plastically deformable, i.e. it undergoes, in particular, no irreversible modifications of its structure when it is brought to this temperature. Thus, it may be reused for several cycles of heat treatment without deforming.

In some embodiments, the holder comprises a titanium-based alloy having a titanium content that is greater than or equal to 90% by weight, more preferably greater than or equal to 99%. For example, the holder may comprise a titanium-based alloy selected from among the following: T40, T60, TiAl6V4, TiAl-48-2-2.

Alternatively, the holder may comprise a zirconium-based alloy selected from among the following: Zircaloy-2, Zircaloy-4.

Preferably, the holder has a thickness of between 0.1 mm and 20 mm. Also preferably, the anti-diffusion barrier comprises alumina or yttrium oxide (Yttria).

Also preferably, the plate is stripped. "Stripped" means any treatment intended to erode the upper surface of the holder intended to support the preform, such as for example: by polishing, milling, sanding . . . . This treatment makes it possible to eliminate the oxide layer that may form on the holder when it is in the presence of oxygen (the oxygen of the air for example), but also to increase the reactive surface to capture the oxygen during the heat treatment.

The heat treatment of the preform may be a sintering of the preform, wherein the predefined temperature of the heat treatment is the temperature of a sintering step.

BRIEF DESCRIPTION OF THE DRAWINGS

Other features and advantages of the present invention will become apparent from the description given below, with reference to the accompanying drawings which illustrate an embodiment having no limiting character:

FIG. 1 shows a schematic sectional view of a holder according to the invention positioned in the enclosure of a furnace and surmounted by a preform intended to be heat treated.

DETAILED DESCRIPTION OF THE INVENTION

The invention will now be described in its application to sintering a titanium-based alloy powder part preform for the purpose of reducing oxygen contamination of the sintered part.

It should be noted that the invention is not limited only to the sintering of powder preforms, but may also be implemented in any type of heat treatment requiring protection against oxidation, for example debinding a powder blank mixed with a binder.

FIG. 1 shows very schematically the enclosure 2 of a furnace 1, which is used to carry out the high temperature sintering of a preform 3.

The preform 3 is made by shaping a powder of a titanium-based alloy. For example, titanium-based alloys such as: TiAl6V4, Ti-17, Ti-6242, Ti-5553, TiAl-48-2-2, TNMB1, etc. may be used.

In a manner known per se, the shaping of the powder to make the preform 3 may be achieved by using a method of the type MIM ("Metal Injection Molding"), HIP ("Hot Isostatic Pressing"), by casting powder, by tape casting, extrusion, etc.

A sole 4 is disposed in the enclosure 2, but may also be integrated in the furnace. This sole 4 may consist of a molybdenum alloy plate (for example of the TZM type) or graphite. It should be noted that in practice several soles 4 may be present in the sintering chamber. For reasons of simplification, only one sole 4 has been shown.

A tray 5 of ceramic material may possibly overcome the sole 4 of the furnace. This ceramic tray 5 may, for example, comprise zirconia ($ZrO_2$), alumina ($Al_2O_3$) or yttria ($Y_2O_3$).

According to the invention, a holder 6 is placed on the ceramic plate 5. This holder 6, in this case takes the form of a holder plate 6 and is made of a metal or a metal alloy which has reducing properties with respect to titanium dioxide ($TiO_2$) in particular. The holder plate 6 then acts as an oxygen trap, not only for the oxygen present in the atmosphere of the chamber 2, but also for the oxygen present in the preform 3 which is arranged on the holder plate 6, and the tools present in the furnace. In addition, this holder plate 6 also serves as a barrier for the oxygen present in the ceramic tray 5 and the sole 4, which can no longer reach the preform 3 during sintering.

It is preferable for the holder 6 to cover the ceramic tray 5 or the sole 4 as much as possible in order to limit the contamination of oxygen coming from these tools. Advantageously, the holder plate 6 covers the base of the enclosure 2 of the furnace 1.

The thickness e of the holder 6 may, for example, be between 0.1 mm and 20 mm.

Materials which have the required reducing properties may be chosen, for example, from among titanium-based alloys or zirconium-based alloys which have sufficiently high mass contents of these elements.

A titanium-based alloy for the holder 6 according to the invention preferably has a titanium mass content greater than or equal to 45%, more preferably a titanium mass content greater than or equal to 90%, or even more preferably a mass content of titanium greater than or equal to 99%. For example, such an alloy may be selected from among the following known alloys: T40, T60, TiAl6V4, TiAl-48-2-2.

Alternatively, a zirconium-based alloy for the holder plate 6 according to the invention preferably has a zirconium mass content greater than or equal to 95%. For example, such an alloy may be selected from among the following known alloys: Zircaloy-2, Zircaloy-4.

In addition, the holder plate 6 is preferably almost plastically deformable at the heat treatment temperatures envisaged, which means that its mechanical properties and its shape are not affected by the temperatures to which it will be subjected. In other words, the holder plate 6 must be dimensionally stable, but it may however suffer slight deformations due to the mass of the part that it supports.

In practice, the melting temperature of the material constituting the holder plate 6 is higher than the highest temperature to which it will be subjected during the heat treatment. In the case of sintering a titanium-based alloy powder preform, the sintering temperature is generally higher than 1100° C. Thus, it is necessary, for example, that the melting temperature of the material constituting the holder plate 6 is at least higher than 1100° C.

It is advantageous to strip the holder plate 6 before positioning it in the furnace 1. To do this, it may be polished, milled or sanded. This stripping treatment makes it possible to remove any oxide layer that may have formed on the holder plate 6 in the open air. In addition, the stripping also makes it possible to increase the reactive surface area of the holder plate 6 to improve the oxygen trapping.

The holder plate 6 is covered at least in part with an anti-diffusion barrier 7 (for example based on alumina or yttria), in order to prevent the preform 3, which is then arranged on the holder plate 6, from adhering to this because of the diffusion of the metallic elements (by a welding-diffusion phenomenon). The anti-diffusion barrier is thus arranged between the holder plate 6 and the preform 3. The deposition of the anti-diffusion barrier 7 may be performed directly by applying a layer of powder by a brush or sprayed from a solution.

It should also be noted that an anti-diffusion barrier similar to that described above may be arranged between the ceramic plate 5 and the holder 6 (or between the sole 4 and the holder 6, as the case may be) in order to avoid their adhering to each other.

Once all the tools and the preform are positioned in the furnace, the preform 3 may be sintered. The operating conditions for sintering a titanium-based alloy powder preform are known to the person skilled in the art and will not be described in more detail here.

EXAMPLE

The sintering of an aircraft turbine engine turbine blade powder preform is carried out, shaped by a metal injection molding (MIM) process. The powder used comprises a titanium-based alloy of the TiAl-48-2-2 type.

The holder 6 used in this example comprises a titanium-based alloy of the TiAl6V4 type, and is covered with an anti-diffusion yttrium oxide (yttria) barrier by spray from a solution.

The sintering of the preform is carried out at a temperature of between 1380° C. and 1445° C. for a period of between 2 hours and 10 hours under a neutral atmosphere of argon.

The oxygen content in the final piece after sintering (measured according to EN10276 standard) is of the order of 1300 ppm. By way of comparison, when the preform is sintered under the same conditions without using a plate according to the invention, the oxygen content in the part reaches 4500 ppm. Thus, in this example, the use of a plate according to the invention makes it possible to divide the oxygen contamination in the final part by a factor of 3.5.

The invention claimed is:

1. A method for heat treating a powder part preform comprising a titanium-based alloy, wherein the method comprises the heat treatment of the powder part preform in a furnace at a predetermined temperature, wherein the powder part preform is on a holder during the heat treatment, wherein the holder comprises a zirconium-based alloy having a zirconium content greater than or equal to 95% by weight, wherein a material of the holder has a melting temperature higher than the predetermined temperature of the heat treatment, and wherein an anti-diffusion barrier is arranged between the powder part preform and the holder in order to prevent welding of the powder part preform to the holder.

2. The method according to claim 1, wherein the holder comprises a zirconium alloy selected from among the following: Zircaloy-2 or Zircaloy-4.

3. The method according to claim 1, wherein the holder has a thickness of between 0.1 mm and 20 mm.

4. The method according to claim 1, wherein the anti-diffusion barrier comprises alumina or yttrium oxide.

5. The method according to claim 1, wherein the method further comprises: stripping the holder, before the heat treatment, to remove an oxide layer formed thereon.

6. The method according to claim 1, wherein the heat treatment of the powder part preform is sintering of the powder part preform, wherein the predetermined temperature of the heat treatment is the temperature of a sintering step.

7. A method for heat treating a powder part preform of a turbomachine part comprising a titanium-based alloy, wherein the method comprises performing the method according to claim 1.

* * * * *